US008840266B1

(12) United States Patent
Wheeler

(10) Patent No.: US 8,840,266 B1
(45) Date of Patent: Sep. 23, 2014

(54) MODULAR POWER-DELIVERY SYSTEM

(71) Applicant: Anthony Wheeler, Huntington, WV (US)

(72) Inventor: Anthony Wheeler, Huntington, WV (US)

(73) Assignee: Paris Incorporated, Huntington, WV (US)

( * ) Notice: Subject to any disclaimer, the term of this patent is extended or adjusted under 35 U.S.C. 154(b) by 48 days.

(21) Appl. No.: 13/756,652

(22) Filed: Feb. 1, 2013

Related U.S. Application Data

(60) Provisional application No. 61/595,002, filed on Feb. 3, 2012.

(51) Int. Cl.
*F21S 4/00* (2006.01)
*H01R 25/00* (2006.01)
*F21V 21/00* (2006.01)

(52) U.S. Cl.
CPC ..... *H01R 25/00* (2013.01); *F21V 21/00* (2013.01)
USPC ..... 362/225; 362/249.01

(58) Field of Classification Search
USPC ..... 362/225; 439/502
See application file for complete search history.

(56) References Cited

U.S. PATENT DOCUMENTS 4,639,841 A 1/1987 Salestrom et al.
4,705,483 A 11/1987 Davis et al.
4,866,583 A 9/1989 Targetti
5,559,393 A 9/1996 Nilssen
5,611,163 A 3/1997 Smith
5,634,287 A 6/1997 Lamparter
5,679,023 A 10/1997 Anderson, Jr. et al.
5,702,176 A 12/1997 Engle
5,729,925 A 3/1998 Prothero
5,751,117 A 5/1998 Abbott
5,816,849 A * 10/1998 Schmidt ..... 439/505
5,964,051 A 10/1999 Loeber et al.
6,435,697 B1 8/2002 Simmons et al.
6,540,549 B2 * 4/2003 Rupert ..... 439/502
6,702,453 B2 3/2004 Weedon
6,939,179 B1 9/2005 Kieffer, Jr. et al.
6,964,504 B2 11/2005 Newbold
7,021,792 B2 4/2006 Lin
7,027,483 B2 * 4/2006 Santhoff et al. ..... 375/130
7,033,209 B2 4/2006 Swiatek et al.
7,229,302 B1 6/2007 Lai
7,401,946 B2 7/2008 Laukhuf
7,445,353 B2 11/2008 Fiene
7,481,670 B2 1/2009 Chen
7,494,241 B2 2/2009 McCarthy et al.
7,658,505 B2 * 2/2010 Howell ..... 362/147
7,826,202 B2 11/2010 Johnson et al.
7,871,180 B2 1/2011 Wu et al.
7,901,242 B2 3/2011 Chen
8,376,782 B2 * 2/2013 Govekar ..... 439/652
2004/0154199 A1 8/2004 Robinson et al.
2004/0248462 A1 * 12/2004 Dyer et al. ..... 439/502
2007/0109710 A1 5/2007 Milan
2007/0111592 A1 * 5/2007 Smith ..... 439/502
2008/0210465 A1 9/2008 Fitch et al.
2008/0229636 A1 9/2008 Mancuso (Continued)

*Primary Examiner* — Ali Alavi
(74) *Attorney, Agent, or Firm* — Dinsmore & Shohl LLP

(57) ABSTRACT

A modular power-delivery system comprises at least one power link, at least one power strip, and at least one power supply connector interconnected with a power source to deliver electrical power to one or more electrical components, including articles and objects that may be separately illuminated, operated, or controlled.

20 Claims, 5 Drawing Sheets

(56) References Cited

U.S. PATENT DOCUMENTS

2010/0043263 A1 2/2010 Golle
2010/0090851 A1* 4/2010 Hauser ..... 340/657
2010/0175254 A1 7/2010 Tiberio, Jr.
2011/0021066 A1 1/2011 Squires
2011/0104937 A1 5/2011 Singh

* cited by examiner

MODULAR POWER-DELIVERY SYSTEM

RELATED APPLICATIONS

This application claims the benefit of U.S. Provisional Application No. 61/595,002 filed on Feb. 3, 2012.

BACKGROUND

The specification discloses one or more embodiments of a modular power-delivery system, and more particularly, a modular power-delivery system utilizing circuit cable mutually coupled in various configurations.

There have been numerous attempts at developing a power-delivery system in a direct current (DC) environment without materially altering or modifying individual elements, components, or electrical connections. Electrical branching is a predominant manner by which many former systems have been implemented or installed, requiring material alteration of the electrical supply cable, the protective sheathing, and individual wiring components. However, it is desirable to have a power-delivery system that accommodates branching and extension of the system without altering the electrical conduit, elements, or components.

SUMMARY

In one embodiment described herein, a modular power-delivery system comprises at least one power link comprises a circuit cable terminating with at least one male connector, at least one power strip comprises at least one male connector and at one female receptacle depending from a junction comprising a plurality of arms, the at least one power strip mutually coupled with the at least one power link, at least one power strip extension comprises a circuit cable terminating with at least one male connector and at least one female connector opposing the at least one male connector, the at least one power strip extension mutually coupled with the at least one power strip, and a power supply connector comprises a female receptacle, the power supply connector mutually coupled with the at least one power strip. Each one of the male connectors comprises at least one positive pin and at least one negative pin. Each one of the female receptacles comprises at least one positive pin receptacle and at least one negative pin receptacle. In one embodiment, at least one positive pin or one negative pin comprise dimensions different from the other pin, and at least one of the corresponding positive pin receptacle or negative pin receptacle comprise different dimensions to accommodate the different dimensions of the positive pin or negative pin. In another embodiment, each one of the male connectors comprises at least one ground pin, at least one positive pin and at least one negative pin, wherein the at least one ground pin has a greater length than the at least one positive pin and the at least one negative pin. Each one of the female receptacles comprises at least one ground pin receptacle, at least one positive pin receptacle, and at least one negative pin receptacle.

In another embodiment described herein, an illuminated sign apparatus comprises at least one sign section adapted for illumination, illumination means for illuminating the at least one sign section, and a power source electrically coupled to the illumination means. A power supply connector is mutually coupled with the power source, the power supply connector comprising a female receptacle. At least one power strip comprises at least one male connector and at one female receptacle depending from a junction comprising a plurality of arms, the at least one power strip mutually coupled with the power supply connector, and at least one power link comprises a circuit cable terminating with at least one male connector, the at least one power link mutually coupled to the at least one power strip, and the at least one power link mutually coupled to the illumination means. Each one of the male connectors comprises at least one positive pin and at least one negative pin. Each one of the female receptacles comprises at least one positive pin receptacle and at least one negative pin receptacle. In one embodiment, at least one positive pin or one negative pin comprise dimensions different from the other pin, and at least one of the corresponding positive pin receptacle or negative pin receptacle comprise different dimensions to accommodate the different dimensions of the positive pin or negative pin. In another embodiment, each one of the male connectors comprises at least one ground pin, at least one positive pin and at least one negative pin, wherein the at least one ground pin has a greater length than the at least one positive pin and the at least one negative pin. Each one of the female receptacles comprises at least one ground pin receptacle, at least one positive pin receptacle, and at least one negative pin receptacle.

In another embodiment described herein, a plurality of illuminated articles comprises a first article and a second article electrically coupled, first illumination means for illuminating the first article and second illumination means for illuminating the second article, and a power source electrically coupled to at least one of the first illumination means or second illumination means. A power supply connector is mutually coupled with the power source, the power supply connector comprising a female receptacle. At least one power strip comprises at least one male connector and at one female receptacle depending from a junction comprising a plurality of arms, the at least one power strip mutually coupled with the power supply connector. At least one power link comprises a circuit cable terminating with at least one male connector, the at least one power link mutually coupled to the at least one power strip, and the at least one power link mutually coupled to one of the first illumination means or second illumination means, and at least one power strip extension comprises a circuit cable terminating with at least one male connector and at least one female connector opposing the at least one male connector, the at least one power strip extension mutually coupled with the at least one power strip. At least one additional power link mutually coupled to the at least one power strip extension, and the at least one additional power link mutually coupled to the remaining one of the first illumination means or second illumination means. Each one of the male connectors comprises at least one positive pin and at least one negative pin. Each one of the female receptacles comprises at least one positive pin receptacle and at least one negative pin receptacle. In one embodiment, at least one positive pin or one negative pin comprise dimensions different from the other pin, and at least one of the corresponding positive pin receptacle or negative pin receptacle comprise different dimensions to accommodate the different dimensions of the positive pin or negative pin. In another embodiment, each one of the male connectors comprises at least one ground pin, at least one positive pin and at least one negative pin, wherein the at least one ground pin has a greater length than the at least one positive pin and the at least one negative pin. Each one of the female receptacles comprises at least one ground pin receptacle, at least one positive pin receptacle, and at least one negative pin receptacle.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION OF THE EMBODIMENT(S)

Figure 1:
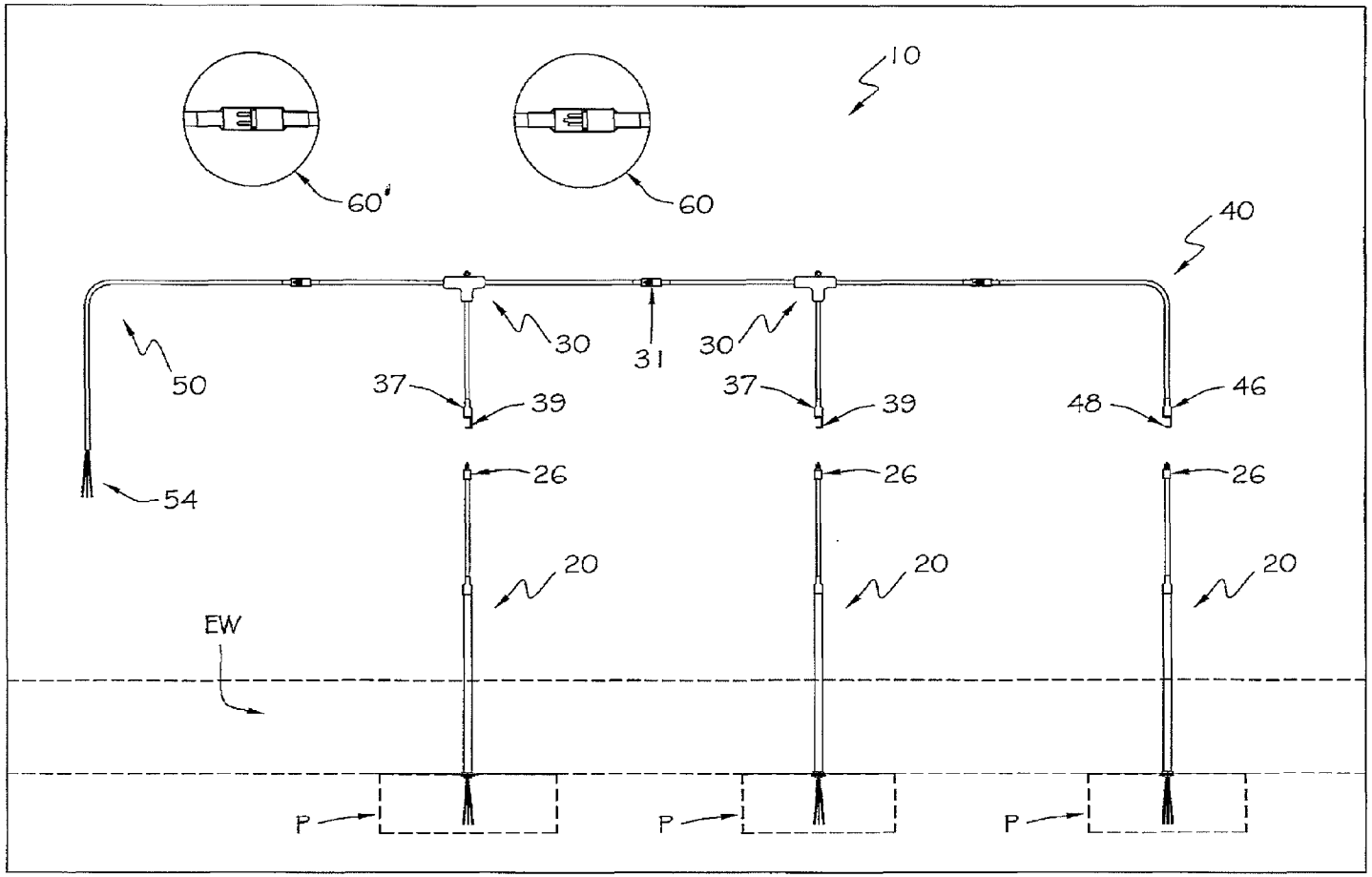
FIG. 1 is a schematic of a modular power delivery system.

As generally depicted in FIG. 1 through FIG. 5, a modular power-delivery system 10 is disclosed and described. In one embodiment, the system 10 comprises at least one power link 20, at least one power strip 30, at least one power strip extension 40, and at least one power supply connector 50. By way of example, and not a limitation on the application of the system 10, the system 10 may be utilized in the illumination of exterior signage for organizations, businesses, or the like, as well as articles used to illuminate areas, including interior and/or exterior lights or similar objects.

Figure 2:
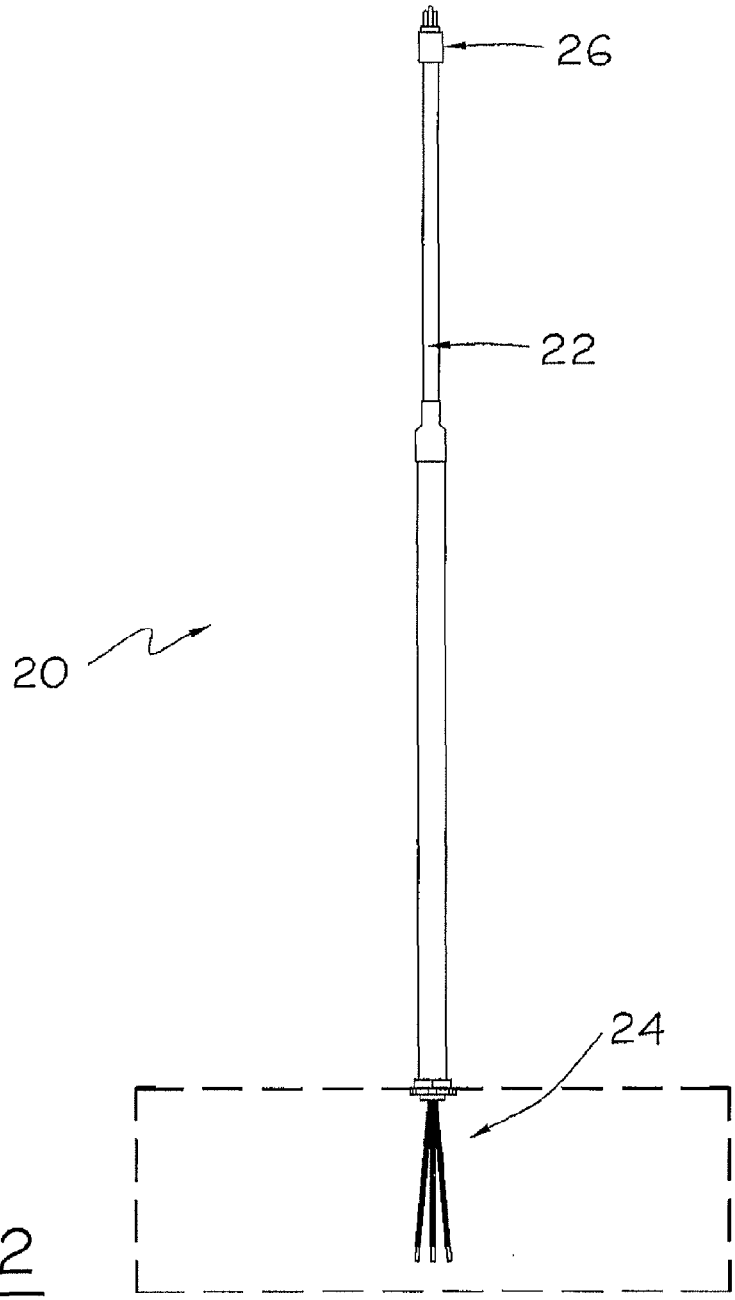
FIG. 2 is a schematic of a power link.

As depicted in FIG. 2, the power link 20 comprises an elongated circuit cable 22 having an end 24 coupled to the direct current (DC) source and an opposing end comprising a three-pin plug (male) 26. End 24 may comprise a wire whip for direct coupling with the power supply. The wire whip and conductors are protected on part of its length end 24 using tubing or sheathing.

As depicted in FIG. 1 through FIG. 4, the three-pin plug (male connector) denoted by reference characters 26, 35 (FIG. 3), and 44 (FIG. 4), each comprise a positive pin, a negative pin, and a ground pin. As depicted, in one embodiment, the positive pin and the negative pin are substantially the same dimension, including diameter and length. Also as depicted, the ground pin is longer in length than the positive pin and negative pin. By having the ground pin with a longer length, when coupling the various elements, the ground pin enters the associated female receptacle (denoted by reference characters 31, 39, and 46) before the positive or negative pins, thereby grounding the electricity before establishing a live connection. Such a connection is generally shown and denoted in FIG. 1 by reference character 60 (inset). Similarly, the longer length of the ground pin provides longer contact with the ground receptacle of the female receptacle, allowing any residual electricity to dissipate to ground before disconnection of the various elements occurs. Thus, the elongated ground pin provides a safety feature for connecting and disconnecting the various elements described herein.

Similarly, the associated female receptacles (31, 39, and 46) each comprise a positive pin receptacle, a negative pin receptacle, and a ground pin receptacle. The positive pin receptacle receives the positive pin of the male connector. The negative pin receptacle receives the negative pin of the male connector. The ground pin receptacle receives the ground pin of the male connector. Each female receptacle may include a retention clip (denoted by reference characters 39, 48, and 58) to provide support, protection, and some resistance to inadvertent removal of the connections formed between the male connector and female receptacle (as generally shown in FIG. 1 inset for 60).

It is also envisioned that a two-pin plug may be used in lieu of a three-pin plug (as generally shown in FIG. 1 inset for 60'). In the description that follows, it is envisioned that a two-pin plug may be substituted for the three-pin plug described above and used in illustrative purposes herein. Accordingly, the associated female receptacle would include at least a two-pin receptacle configuration, including at least one positive pin receptacle and one negative pin receptacle. Therefore, the descriptions contained herein should not be considered limited only to the three-pin plug and three-pin receptacle used for illustration and discussion herein.

In a two-pin version, the ground pin is removed or omitted yielding a positive pin and a negative pin. It is envisioned that one embodiment would include a positive pin and a negative pin of a two-pin plug having identical dimensions. However, the positive pin and the negative pin may have different dimensions, and the female receptacle may have a positive pin receptacle and a negative pin receptacle corresponding to the dimensions of the respective pins. This arrangement is also applicable to the three-pin plug, wherein the negative pin and positive pin have different dimensions as would the female receptacle and the respective receptacles for the pin. This arrangement would prevent inadvertent coupling of an inappropriate pin with an inappropriate pin receptacle. In another embodiment, the pins and the associated receptacles are offset so that the positive pin cannot be inadvertently inserted in the negative pin receptacle and the negative pin cannot be inadvertently inserted in the positive pin receptacle. These variations and alternate configurations are envisioned as suitable for use in multiple applications, including any system, apparatus, article, or device that may incorporate one or more aspects of the elements described and disclosed.

Figure 3:
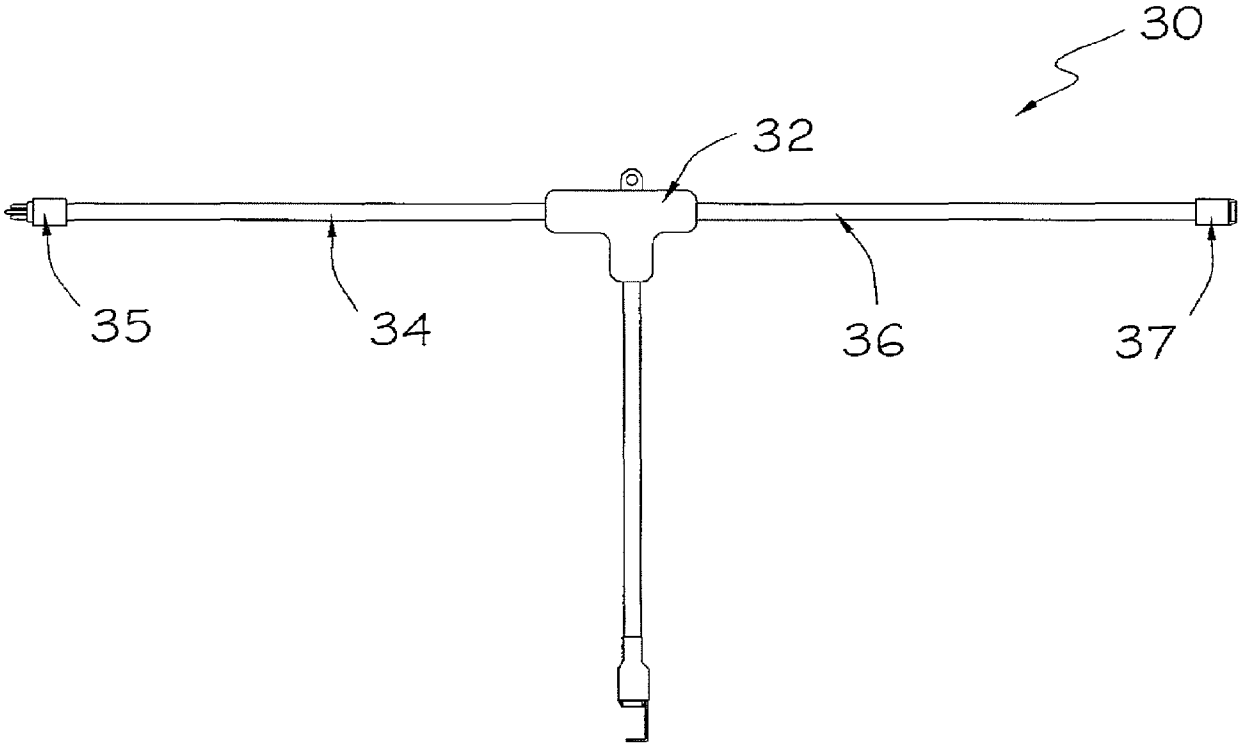
FIG. 3 is a schematic of a power strip.

As depicted in FIG. 3, the power strip 30 comprises a T-shaped component having three elongated circuit cables of each conductor. The power strip 30 may include a three-conductor junction 32 receiving three elongated circuit cables 34, 36, and 38. One of the cables 34 comprises a three-pin plug (male) connector 35. Two of the cables 36 and 38 comprise three-pin female receptacles 37. As noted above, one of the female receptacles may include a retention clip 39. The power strip 30 provides a split of the electrical power from the main line to the power link 20 coupled to the power strip 30.

Figure 4:
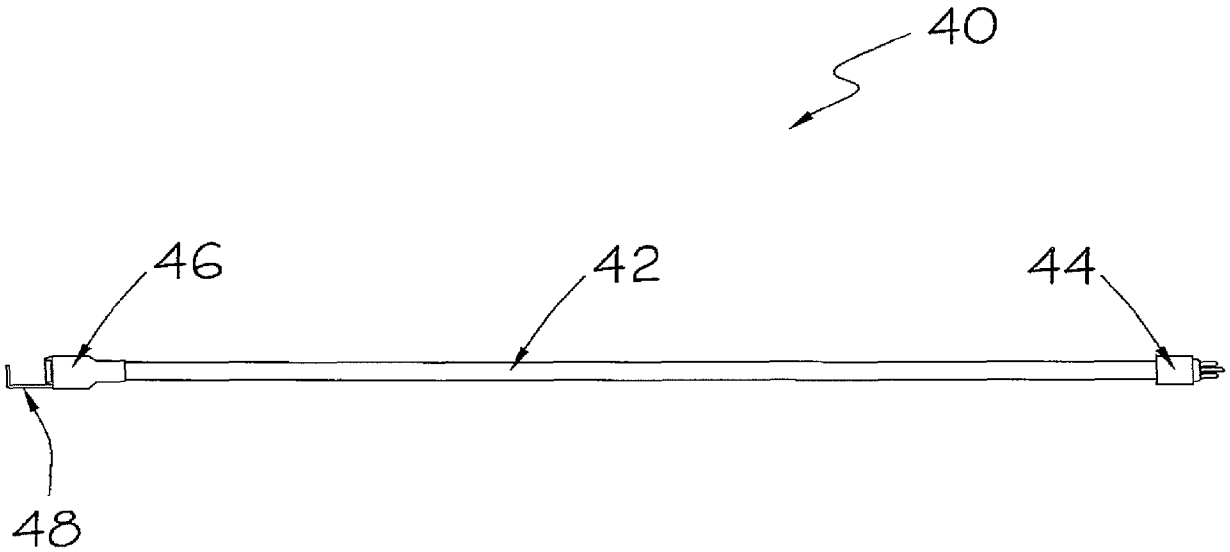
FIG. 4 is a schematic of a power strip extension.

As depicted in FIG. 4, the power strip extension 40 comprises an elongated circuit cable 42. The cable 42 has an end comprising a three-pin plug (male) connector 44 and an opposing end comprising a three-pin receptacle (female) connector 46. The female connector 46 may include a retention clip 48. The extension 40 comprises an extension between any other component(s) 20, 30, and/or 50 of the system 10.

Figure 5:
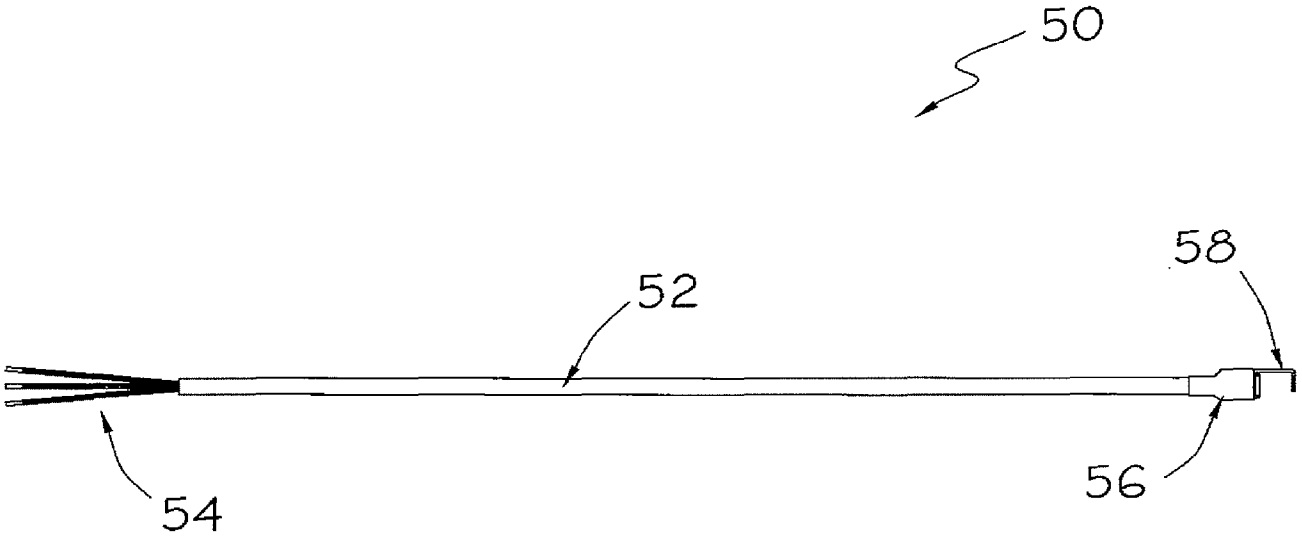
FIG. 5 is a schematic of a power supply connector.

As depicted in FIG. 5, the power supply connector 50 comprises an elongated circuit cable 52 having one end comprising a wire whip 54 and an opposing end comprising a three-pin female receptacle 56. A retention clip 58 is positioned at the receptacle 56 for securing a male connector component provided on a power link 20, and/or a power strip 30, and/or an extension 40. One end attaches to point that is providing power and the other end has a female receptacle with a retention clip for attaching to complete harness. This component provides redundancy in the system 10 in the event that an electrical defect develops in other power supply sources or circuit cables in the system 10. This component can be any length depending on application.

As depicted in FIG. 1, the system 10 may be installed in electrical communication with a power source with a sign section (generally denoted by "P") within an exterior wall (generally denoted by "EW"). The wire whip 24 of power link 20 may be directly coupled with DC electrical power at the power source P to provide the electrical supply to the remainder of the system 10. Such an arrangement may be utilized with multiple sign sections as depicted in FIG. 1. A male connector 26 (of power link 20) may be coupled to a female receptacle 37 and clip 39 of the power strip 30. As depicted, multiple connections are provided to adjacent power strips 30, wherein the power strips 30 are electrically coupled at junction 31 utilizing the male connector 35 of one strip 30 and the female receptacle 37 of the adjacent strip 30 (generally denoted by inset of reference character 60). A third power link 20 is depicted electrically coupled to a power strip extension 40, wherein the male connector 26 is coupled to the female receptacle 46 and clip 48. The extension 40 is further coupled to one of the adjacent power strips 30. Finally, a power supply connector 50 is depicted as electrically coupled from one of the power strips 30, the wire whip 54 available for further downstream electrical coupling.

The modular power delivery system comprises multiple components that connect together into a harness allowing various configurations. Any quantity of points requiring power can be provided using this system. The system can include any number of conductors depending on the application. The system is convertible in the field if additional connections are required.

It should be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A modular power-delivery system comprising:

at least one power link comprises a circuit cable terminating with at least one male connector;

at least one power strip comprises at least one male connector and at one female receptacle depending from a junction comprising a plurality of arms, the at least one power strip mutually coupled with the at least one power link;

at least one power strip extension comprises a circuit cable terminating with at least one male connector and at least one female connector opposing the at least one male connector, the at least one power strip extension mutually coupled with the at least one power strip; and a power supply connector comprises a female receptacle, the power supply connector mutually coupled with the at least one power strip;

each one of the male connectors comprises at least at least one positive pin and at least one negative pin, wherein at least one of the positive pin and the negative pin comprise different dimensions; and each one of the female receptacles comprises at least one positive pin receptacle and at least one negative pin receptacle, wherein at least one of the positive pin receptacle and the negative pin receptacle comprise different dimensions corresponding with the different dimensions of the at least one positive pin or at least one negative pin.

2. The system of claim 1, wherein the at least one power strip comprises a plurality of circuit cables depending from the junction, at least one circuit cable terminating with the at least one male connector, and at least one circuit cable terminating with the at least one female receptacle.

3. The system of claim 2, wherein the at least one female receptacle comprises a retention clip.

4. The system of claim 1, wherein the at least one power supply connector comprises a circuit cable terminating with a wire whip and an opposing female receptacle.

5. The system of claim 1, wherein each one of the male connectors further comprises at least one ground pin.

6. The system of claim 5, wherein each one of the female receptacles further comprises at least one ground pin receptacle.

7. The system of claim 5, wherein the at least one ground pin has a greater length than the at least one positive pin and the at least one negative pin.

8. An illuminated sign apparatus comprising:

at least one sign section adapted for illumination;

illumination means for illuminating the at least one sign section;

a power source electrically coupled to the illumination means;

a power supply connector mutually coupled with the power source, the power supply connector comprising a female receptacle;

at least one power strip comprises at least one male connector and at one female receptacle depending from a junction comprising a plurality of arms, the at least one power strip mutually coupled with the power supply connector;

at least one power link comprises a circuit cable terminating with at least one male connector, the at least one power link mutually coupled to the at least one power strip, and the at least one power link mutually coupled to the illumination means;

each one of the male connectors comprises at least at least one positive pin and at least one negative pin, wherein at least one of the positive pin and the negative pin comprise different dimensions; and each one of the female receptacles comprises at least one positive pin receptacle and at least one negative pin receptacle, wherein at least one of the positive pin receptacle and the negative pin receptacle comprise different dimensions corresponding with the different dimensions of the at least one positive pin or at least one negative pin.

9. The apparatus of claim 8 further comprising at least one additional sign section adapted for illumination;

illumination means for illuminating the at least one additional sign section;

at least one power strip extension comprises a circuit cable terminating with at least one male connector and at least one female connector opposing the at least one male connector, the at least one power strip extension mutually coupled with the at least one power strip; and at least one additional power link mutually coupled to the at least one power strip extension, and the at least one additional power link mutually coupled to the at least one additional illumination means.

10. The apparatus of claim 8, wherein the at least one power strip comprises a plurality of circuit cables depending from the junction, at least one circuit cable terminating with the at least one male connector, and at least one circuit cable terminating with the at least one female receptacle.

11. The apparatus of claim 10, wherein the at least one female receptacle comprises a retention clip.

12. The apparatus of claim 8, wherein the at least one power supply connector comprises a circuit cable terminating with a wire whip and an opposing female receptacle.

13. The apparatus of claim 8, wherein each one of the male connectors further comprises at least one ground pin.

14. The apparatus of claim 13, wherein each one of the female receptacles further comprises at least one ground pin receptacle.

15. The apparatus of claim 13, wherein the at least one ground pin has a greater length than the at least one positive pin and the at least one negative pin.

16. A plurality of illuminated articles comprising:

a first article and a second article electrically coupled;

first illumination means for illuminating the first article and second illumination means for illuminating the second article;

a power source electrically coupled to at least one of the first illumination means or second illumination means;

a power supply connector mutually coupled with the power source, the power supply connector comprising a female receptacle;

at least one power strip comprises at least one male connector and at one female receptacle depending from a junction comprising a plurality of arms, the at least one power strip mutually coupled with the power supply connector;

at least one power link comprises a circuit cable terminating with at least one male connector, the at least one power link mutually coupled to the at least one power strip, and the at least one power link mutually coupled to one of the first illumination means or second illumination means;

at least one power strip extension comprises a circuit cable terminating with at least one male connector and at least one female connector opposing the at least one male connector, the at least one power strip extension mutually coupled with the at least one power strip; and at least one additional power link mutually coupled to the at least one power strip extension, and the at least one additional power link mutually coupled to the remaining one of the first illumination means or second illumination means;

each one of the male connectors comprises at least at least one positive pin and at least one negative pin, wherein at least one of the positive pin and the negative pin comprise different dimensions; and each one of the female receptacles comprises at least one positive pin receptacle and at least one negative pin receptacle, wherein at least one of the positive pin receptacle and the negative pin receptacle comprise different dimensions corresponding with the different dimensions of the at least one positive pin or at least one negative pin.

17. The plurality of illuminated articles of claim 16, wherein the at least one power strip comprises a plurality of circuit cables depending from the junction, at least one circuit cable terminating with the at least one male connector, and at least one circuit cable terminating with the at least one female receptacle.

18. The plurality of illuminated articles of claim 17, wherein the at least one female receptacle comprises a retention clip.

19. The plurality of illuminated articles of claim 16, wherein the at least one power supply connector comprises a circuit cable terminating with a wire whip and an opposing female receptacle.

20. The plurality of illuminated articles of claim 16, wherein:

each one of the male connectors further comprises at least one ground pin having a greater length than the at least one positive pin and the at least one negative pin; and each one of the female receptacles further comprises at least one ground pin receptacle.

* * * * *